US010894701B2

(12) United States Patent
Roodenburg et al.

(10) Patent No.: US 10,894,701 B2
(45) **Date of Patent: *Jan. 19, 2021**

(54) CRANE, VESSEL COMPRISING SUCH A CRANE, AND A METHOD FOR UP-ENDING A LONGITUDINAL STRUCTURE

(71) Applicant: ITREC B.V., Schiedam (NL)

(72) Inventors: Joop Roodenburg, Schiedam (NL); Adrianus Van Der Linde, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/712,451

(22) Filed: Dec. 12, 2019

(65) Prior Publication Data

US 2020/0115197 A1 Apr. 16, 2020

Related U.S. Application Data

(62) Division of application No. 16/333,428, filed as application No. PCT/NL2017/050602 on Sep. 14, 2017, now Pat. No. 10,544,016.

(30) Foreign Application Priority Data

Sep. 15, 2016 (NL) ..... 2017468

(51) Int. Cl.
*B66C 23/52* (2006.01)
*B66C 23/82* (2006.01)
(Continued)

(52) U.S. Cl.
CPC ..... *B66C 23/84* (2013.01); *B66C 23/185* (2013.01); *B66C 23/52* (2013.01); *B66C 23/82* (2013.01); *B66C 23/828* (2013.01)

(58) Field of Classification Search
CPC ..... B66C 23/52; B66C 23/56; B66C 23/64; B66C 23/66; B63B 27/10; B63B 27/36; B63B 23/04
See application file for complete search history.

(56) References Cited

U.S. PATENT DOCUMENTS 3,591,022 A 7/1971 Polyakov
4,076,128 A 2/1978 Tax
(Continued)

FOREIGN PATENT DOCUMENTS

CN 104649155 A 5/2015
WO WO 2009/131442 A1 10/2009
WO WO 2017/217845 A1 12/2017

OTHER PUBLICATIONS

Dutch Search Report, issued in Priority Application No. 2017468, dated May 4, 2017.
(Continued)

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A method for up-ending a longitudinal structure, being one of a foundation of an offshore wind turbine or a wind turbine tower to be installed on top of a previously installed foundation, wherein use is made of a crane The method includes providing a longitudinal structure with an upper end and a lower end in a substantially horizontal orientation; connecting the middle hoisting block of three main hoisting systems and one outer hoisting block of the three main hoisting systems to the upper end of the longitudinal structure; connecting another other outer hoisting block of the three main hoisting systems to the lower end of the longitudinal structure; and operating respective winches of the three main
(Continued)

hoisting systems until the longitudinal structure is in a substantially vertical orientation with the upper end above the lower end.

6 Claims, 10 Drawing Sheets

(51) Int. Cl.
*B66C 23/18* (2006.01)
*B66C 23/84* (2006.01)

(56) References Cited

U.S. PATENT DOCUMENTS 4,280,628 A 7/1981 Goss et al.
4,383,616 A 5/1983 Sterner et al.
4,838,522 A 6/1989 Calkins
4,892,202 A 1/1990 Hey et al.
4,919,393 A 4/1990 Calkins
4,951,924 A 8/1990 Calkins
5,580,189 A 12/1996 Sanders et al.
2007/0084816 A1 4/2007 Roodenburg et al.
2008/0169257 A1 7/2008 Roodenburg et al.
2008/0237170 A1 10/2008 Altman et al.
2008/0237171 A1 10/2008 Altman et al.
2008/0237173 A1 10/2008 Altman et al.
2008/0237174 A1 10/2008 Altman et al.
2008/0240863 A1 10/2008 Altman et al.
2008/0247827 A1 10/2008 Altman et al.
2008/0251484 A1 10/2008 Commandeur et al.
2009/0028647 A1 1/2009 Bingham et al.
2010/0044331 A1 2/2010 Roodenburg et al.
2010/0067989 A1 3/2010 Brown et al.
2010/0102017 A1 4/2010 Roodenburg et al.
2010/0294737 A1 11/2010 Roodenburg et al.
2010/0307401 A1 12/2010 Bereznitski et al.
2011/0031205 A1 2/2011 Roodenburg
2011/0036287 A1 2/2011 Wijning et al.
2011/0114587 A1 5/2011 Roodenburg et al.
2012/0217063 A1 8/2012 Roodenburg et al.
2012/0266797 A1 10/2012 Ardavanis et al.
2013/0168345 A1 7/2013 Hey
2014/0166604 A1 6/2014 Hey
2014/0334880 A1 11/2014 Roodenburg et al.
2015/0112638 A1 4/2015 Morrow et al.
2016/0289051 A1 10/2016 Chiasson
2016/0368743 A1 12/2016 De Groot et al.

OTHER PUBLICATIONS

International Search Report, issued in PCT/NL2017/050602, dated Jan. 3, 2018.
Written Opinion of the International Searching Authority, issued in PCT/NL2017/050602, dated Jan. 3, 2018.

CRANE, VESSEL COMPRISING SUCH A CRANE, AND A METHOD FOR UP-ENDING A LONGITUDINAL STRUCTURE

CROSS-REFERENCE TO RELATED APPLICATIONS

This application is a Divisional of copending application Ser. No. 16/333,428, filed on Mar. 14, 2019, which is the National Phase under 35 U.S.C. § 371 of International Application No. PCT/NL2017/050602, filed on Sep. 14, 2017, which claims the benefit under 35 U.S.C. § 119(a) to Patent Application No. 2017468, filed in Netherland on Sep. 15, 2016, all of which are hereby expressly incorporated by reference into the present application.

The invention relates to a crane, a vessel comprising such a crane, and a method for up-ending a longitudinal structure.

The invention in particular relates to the field of offshore wind turbine installation and/or maintenance. Current offshore wind turbines require a foundation, e.g. in the form of a monopile. The wind turbine is then installed on the monopile, either in one piece or in several pieces.

In order to make efficient use of wind energy, the trend is to increase the diameter of the rotor of the wind turbine. Wind turbine blades of 60-90 m in length or even larger may be very common in the near future. However, this will also increase the size and weight of all other components including the foundation. It is envisaged that long and large diameter monopiles, e.g. weighing over 2000 mt need to be installed. Practical monopiles have been proposed with lengths of about 100 metres.

Regardless of whether the wind turbine is installed on land or offshore, transporting the monopile to the installation site will mostly be done with the monopile in a substantially horizontal orientation. In order to drive the monopile into the earth, the monopile needs to be up-ended by a crane to be brought in the desired vertical orientation.

Many offshore wind turbine installation vessels are of the jack-up type, with extendible legs and with a crane for installation of the wind turbine. In a known design, the crane is an around-the-leg crane.

Prior art solutions known in the practice of up-ending the monopile comprise methods in which a crane only lifts the upper end of the monopile and the lower end remains supported by the ground or on a deck of the vessel, e.g. by a tilting support frame. A drawback of this method is that control of the lower end is quite challenging, especially when the lower end needs to move relative to the ground or deck, e.g. for overboarding the monopile. Further, up-ending can usually only be done at a limited number of locations where there is enough space for up-ending the monopile with the crane.

Other prior art solutions for up-ending a monopile suggest to use two cranes, such as on the "Rambiz"-boat, one for the upper end and the other one for the lower end of the monopile. However, this requires synchronized operation of the two cranes, where over time, the crane lifting the upper end needs to support more of the weight of the monopile than the crane lifting the lower end. Most wind turbine installation vessels lack two cranes capable of performing this operation and lack space to mount another crane on the vessel for this operation.

In a non-published patent application of the applicant, PCT/NL2017/050393, a solution is suggested in which a single crane using two separate main hoisting systems is used to respectively lift the upper end and lower end of the monopile for up-ending.

US2014/166604 A1 and WO2009/131442 A1 both disclose a crane with two main hoisting systems, comprising an A-frame boom, of which the legs are connected at one end to the crane housing and at the opposite end to each other. The sheave blocks of the main hoisting systems are arranged side by side at the latter end.

However, a drawback of these systems is that as up-ending progresses, the loads carried by the two main hoisting systems start to differ more and more (so-called asymmetric loading of the crane), which is likely to result in undesired torsion loads on the boom of the crane.

It is therefore an object of the invention to provide an improved method for up-ending longitudinal structures and to provide a crane and/or vessel suitable to carry out this improved method.

US2013/168345 AI and CN104649155 A disclose a system having three (or more) sheave arrangements. U.S. Pat. No. 4,280,628A discloses an alternative sheave arrangement.

According to a first aspect of the invention, the mentioned object is achieved by a crane comprising:

- a base structure;
- a slew bearing;
- a crane housing moveably mounted to the base structure via the slew bearing to allow the crane housing to rotate relative to the base structure about a substantially vertical slewing axis;
- a boom moveably mounted to the crane housing to allow the boom to pivot relative to the crane housing about a substantially horizontal first pivot axis;
- three main hoisting systems; and
- a luffing system to set an angular orientation of the boom relative to the crane housing, wherein the boom comprises an A-frame with two boom legs that are connected at one end to the crane housing and at the opposite end to each other via a hammerhead structure, wherein each main hoisting system comprises:

- a hoisting cable;
- a sheave block with one or more sheaves that are rotatable about a sheave rotation axis, which sheave block is arranged on the hammerhead structure of the boom;
- a hoisting block suspended from the sheave block by the hoisting cable; and
- a hoisting winch to lift and lower the hoisting block by hauling in or paying out the hoisting cable, wherein the sheave block of each main hoisting system is pivotable about a substantially horizontal second pivot axis that is perpendicular to the sheave rotation axis of the one or more sheaves of the sheave block, wherein the sheave blocks of the three main hoisting systems are arranged side-by-side, wherein the luffing system comprises:

- two luffing winches on the crane housing;
- two luffing cables extending between the respective two luffing winches on the crane housing and the boom, and wherein the luffing cables are connected to respective outriggers of the hammerhead structure that extend beyond the boom legs of the A-frame seen in plan view.

The main advantage of the crane according to the invention is that the crane is very suitable for asymmetric loads, such as for instance encountered during up-ending of a longitudinal structure. As will be explained later in more detail, two of the three main hoisting systems may be combined to increase the hoisting capacity required for the upper end of a longitudinal structure, e.g. a monopile, while the remaining hoisting system may be used to hold and lift the lower end. Further, the additional degree of freedom as provided to the sheave blocks allow the respective hoisting blocks to be moved sideways in order to be connected to a respective end of the longitudinal structure while keeping the one or more sheaves of the sheave block aligned with the respective hoisting cable and the one or more sheaves of the hoisting blocks. Last but not least, the A-frame construction of the boom provides torsional stiffness against an asymmetric load while at the same time the luffing cables are connected to the boom at a larger distance from the centre of the boom which aids in counteracting the asymmetric load on the boom. As a result thereof, this specific construction of the crane makes the crane very suitable for up-ending heavy longitudinal structures such as monopiles.

In an embodiment, the second pivot axis is parallel to the first pivot axis.

In an embodiment, the boom legs are truss structures. Preferably, the boom legs are further connected to each other in between the two ends of the boom legs, more preferably using truss structures.

In an embodiment, the hammerhead structure comprises a box structure, e.g. a box welded of steel plates forming the outside of the box with possible internal reinforcement members to strengthen the box structure.

In an embodiment, the boom comprises a jib extending from the hammerhead structure. Possibly, the jib is fixed, so non-moveable, to the hammerhead structure, e.g. as a rigid extension of the crane boom.

Preferably, the crane comprises one or more auxiliary hoisting systems having a hoisting cable, sheave block, hoisting block and hoisting winch similar to the main hoisting system, wherein the sheave block is mounted on the jib, e.g. a single such sheave block is arranged on the jib on the longitudinal axis of the boom.

In an embodiment, a centre plane of the A-frame of the boom is defined as the plane spanned by the first pivot axis and the longitudinal axis of the A-frame, wherein the middle sheave block of the three main hoisting systems is mounted at a larger distance from the centre plane than the two outer sheave blocks of the three main hoisting systems.

The invention according to the first aspect also relates to a vessel comprising a crane according to the invention. Such a vessel can be used for offshore wind turbine installation and maintenance, where the crane can be used to up-end a monopile on site.

In an embodiment, the vessel is a jack-up vessel comprising:

- a hull with at least three openings in the hull, said openings extending vertically through the hull to receive a respective leg;
- a leg per opening in the hull; and
- a leg driving device per leg allowing to move the corresponding leg relative to the hull in a vertical direction to allow the hull to be lifted out of a water body.

As a result, the vessel can be stabilized relative to the sea bottom during crane operations, enabling to handle heavy loads, also overboard.

In an embodiment, the base structure and the crane housing of the crane are arranged around an opening in the hull, so that the respective leg can extend through the base structure and crane housing. Such around-the-leg cranes make efficient use of the available deck space on the vessel, while at the same time the weight of the crane including load is efficiently transferred to the respective leg via the hull of the vessel.

The invention according to the first aspect further relates to a method for up-ending a longitudinal structure, e.g. a monopile for a wind turbine, wherein use is made of a crane according to the invention, said method comprising the following steps:

a) providing a longitudinal structure with an upper end and a lower end in a substantially horizontal orientation, e.g. on a deck of a vessel equipped with the crane;
b) connecting the middle hoisting block of the three main hoisting systems and one of the outer hoisting blocks of the three main hoisting systems to the upper end or end portion of the longitudinal structure;
c) connecting the other outer hoisting block of the three main hoisting systems to the lower end or end portion of the longitudinal structure; and
d) operating the respective winches of the three main hoisting systems until the longitudinal structure is in a substantially vertical orientation with the upper end above the lower end.

In an embodiment, connecting the other outer hoisting block of the three main hoisting systems to the lower end of the longitudinal structure comprises the following steps:

c1) providing a gripping element;
c2) providing the gripping element around the lower end or end portion of the longitudinal structure; and
c3) connecting the other outer hoisting block of the three main hoisting systems to the gripping element.

In an embodiment, after connecting the three main hoisting systems, the longitudinal structure is lifted first while remaining in the substantially horizontal orientation, and preferably moved to the installation site, e.g. involving slewing of the crane, before moving the longitudinal structure to the vertical orientation. For example, the longitudinal structure, e.g. monopile, is first moved beyond the hull of the vessel, so overboard, e.g. involving slewing of the crane, and only then moved into its vertical orientation.

In an embodiment, the longitudinal structure is provided such that in plan view a straight line between a centre of gravity of the longitudinal structure and the slewing axis of the crane is perpendicular to a longitudinal axis of the longitudinal structure.

According to a second aspect of the invention, there is provided a method for up-ending a longitudinal structure, e.g. a monopile, e.g. as a foundation of an offshore wind turbine, wherein use is made of a crane comprising:

- a base structure;
- a slew bearing;
- a crane housing moveably mounted to the base structure via the slew bearing to allow the crane housing to rotate relative to the base structure about a substantially vertical slewing axis;
- a boom moveably mounted to the crane housing to allow the boom to pivot relative to the crane housing about a substantially horizontal first pivot axis; and
- three main hoisting systems, wherein the boom preferably comprises an A-frame with two boom legs that are connected at one end to the crane housing and at the opposite end to each other via a connection element, wherein each main hoisting system comprises:

- a hoisting cable;
- a sheave block with one or more sheaves that are rotatable about a sheave rotation axis, which sheave block is arranged on the connection element of the boom;
- a hoisting block suspended from the sheave block by the hoisting cable; and
- a hoisting winch to lift and lower the hoisting block by hauling in or paying out the hoisting cable, wherein the sheave block of each main hoisting system is pivotable about a substantially horizontal second pivot axis that is perpendicular to the sheave rotation axis of the one or more sheaves of the sheave block, wherein the sheave blocks of the three main hoisting systems are arranged side-by-side, and wherein the method comprises the following steps:

a) providing a longitudinal structure with an upper end and a lower end in a substantially horizontal orientation;

b) connecting the middle hoisting block of the three main hoisting systems and one of the outer hoisting blocks of the three main hoisting systems to the upper end of the longitudinal structure;

c) connecting the other outer hoisting block of the three main hoisting systems to the lower end of the longitudinal structure; and d) operating the respective winches of the three main hoisting systems until the longitudinal structure is in a substantially vertical orientation with the upper end above the lower end.

The invention according to the second aspect of the invention further relates to a crane comprising:

a base structure;

a slew bearing;

a crane housing moveably mounted to the base structure via the slew bearing to allow the crane housing to rotate relative to the base structure about a substantially vertical slewing axis;

a boom moveably mounted to the crane housing to allow the boom to pivot relative to the crane housing about a substantially horizontal first pivot axis; and three main hoisting systems, wherein the boom preferably comprises an A-frame with two boom legs that are connected at one end to the crane housing and at the opposite end to each other via a connection element, wherein each main hoisting system comprises:

a hoisting cable;

a sheave block with one or more sheaves that are rotatable about a sheave rotation axis, which sheave block is arranged on the connection element of the boom;

a hoisting block suspended from the sheave block by the hoisting cable; and a hoisting winch to lift and lower the hoisting block by hauling in or paying out the hoisting cable, wherein the sheave block of each main hoisting system is pivotable about a substantially horizontal second pivot axis that is perpendicular to the sheave rotation axis of the one or more sheaves of the sheave block, and wherein the sheave blocks of the three main hoisting systems are arranged side-by-side.

The crane and method according to the second aspect of the invention may be combined with features from the first aspect of the invention where appropriate. For example, the boom is provided with outriggers laterally from both sides of the boom (seen in plan view), each outrigger connected to a luffing cable, e.g. supporting a luffing cable sheave assembly in case of a multiple fall luffing cable arrangement. The boom may be embodied as an A-frame, but other embodiments are envisaged in this second aspect of the invention as well.

It will be appreciated that the crane according to the second aspect may be mounted on a vessel, e.g. as discussed with reference to the first aspect of the invention. The second aspect also relates to such a vessel and also to the use thereof for installation of a wind turbine an/or a wind turbine foundation, e.g. a monopile.

The invention will now be described in more detail in a non-limiting way by reference to the accompanying drawings in which like parts are indicated by like reference symbols, and in which.

Figure 1:
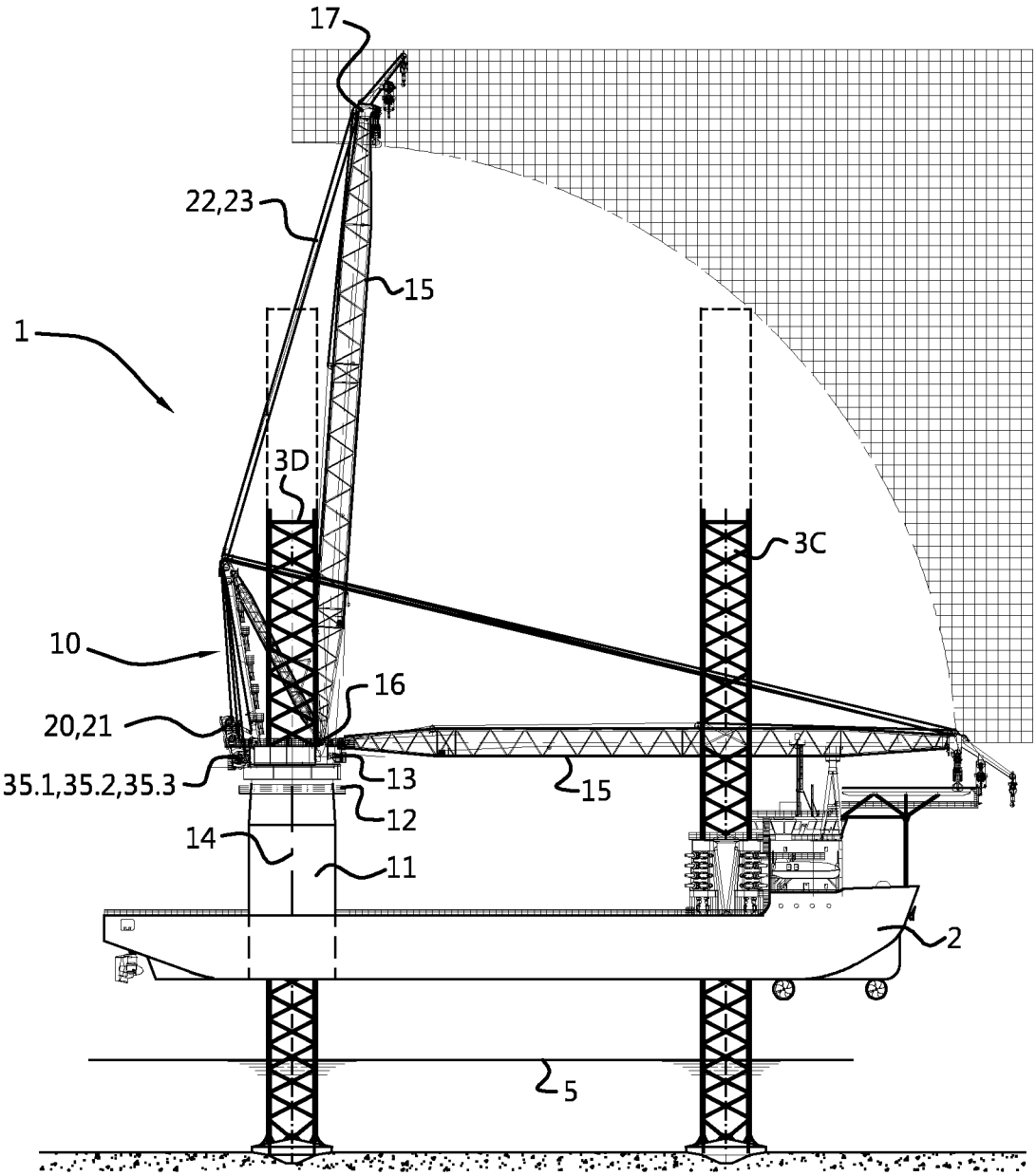
FIG. 1 depicts a side view of a vessel according to an embodiment of the invention.
Figure 6A:
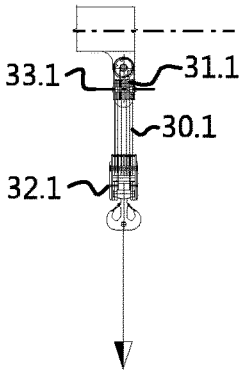
Figure 7A:
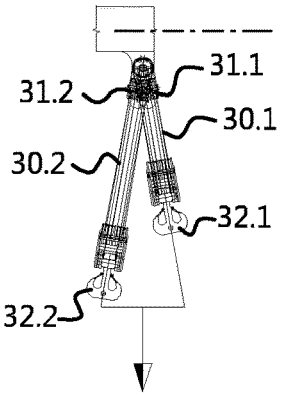
Figure 8A:
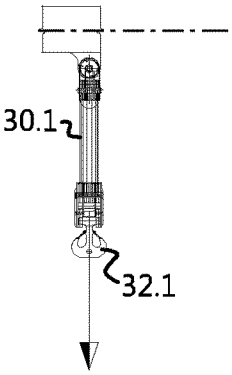
Figure 9:
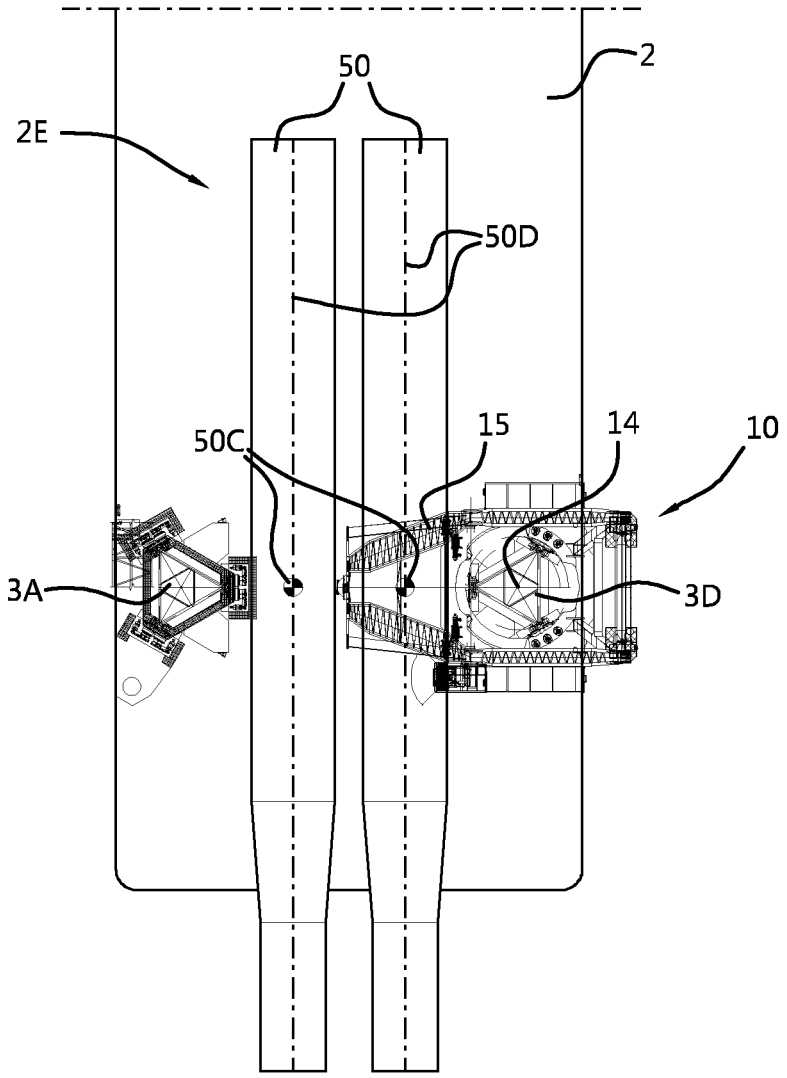
Figure 11:
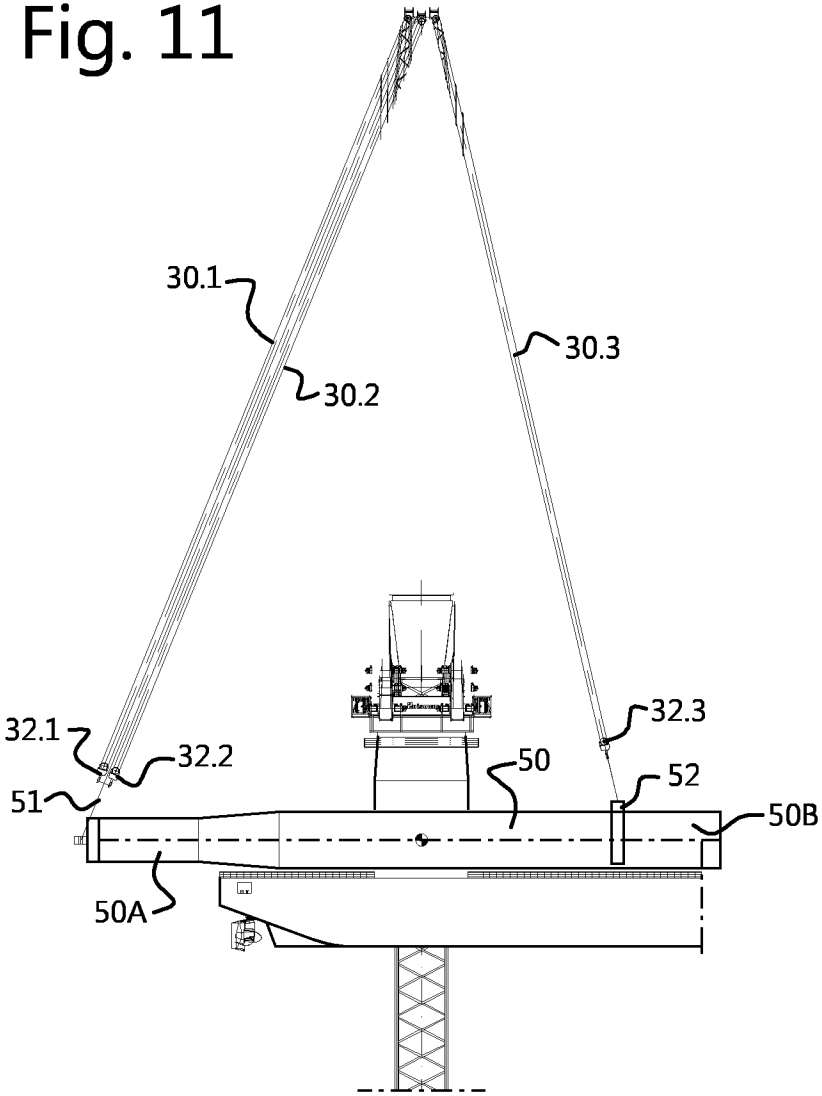
Figure 10:
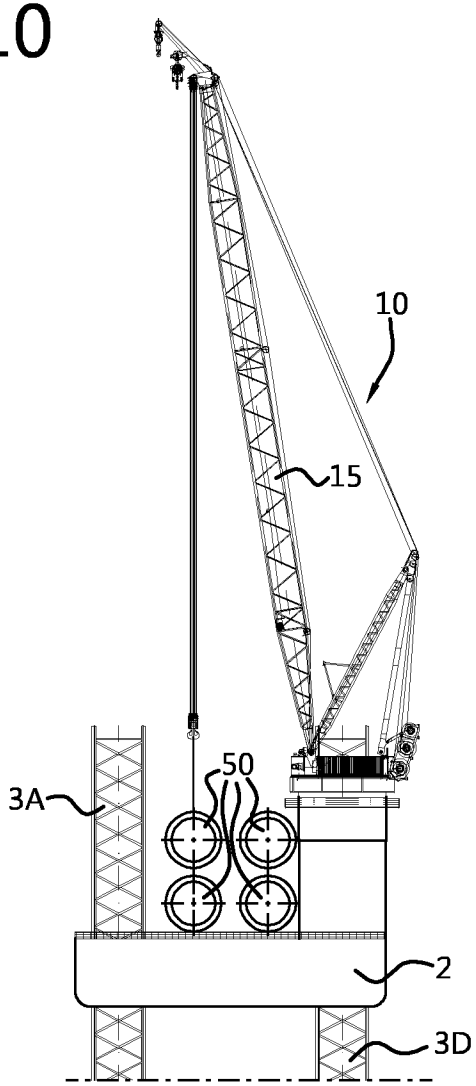
Figure 12:
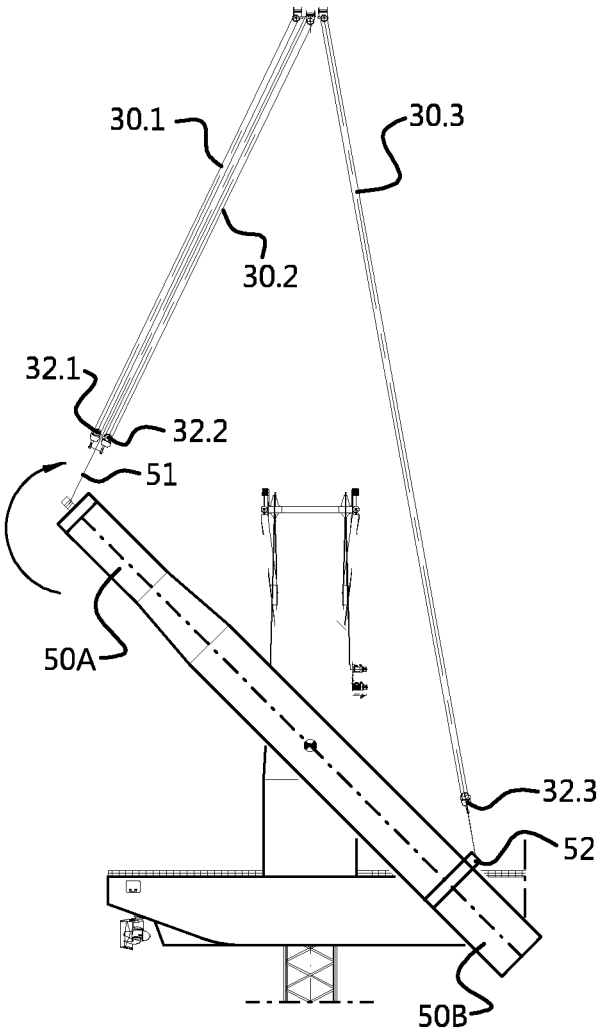
Figure 13:
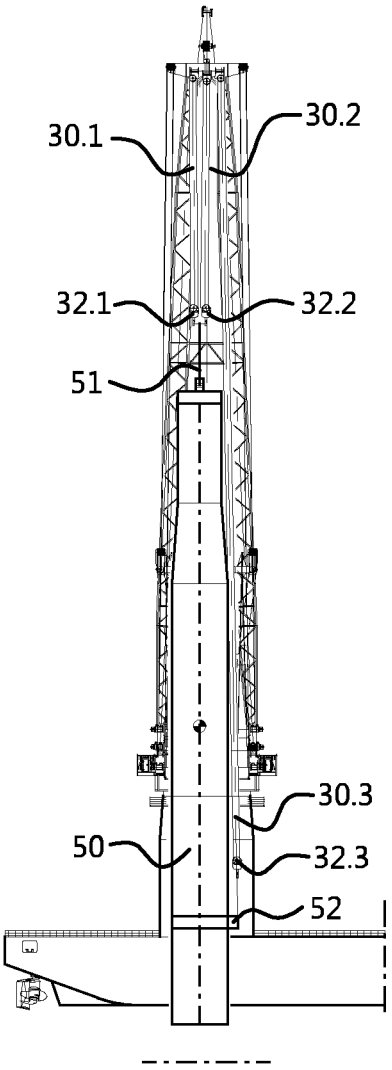
Figure 14:
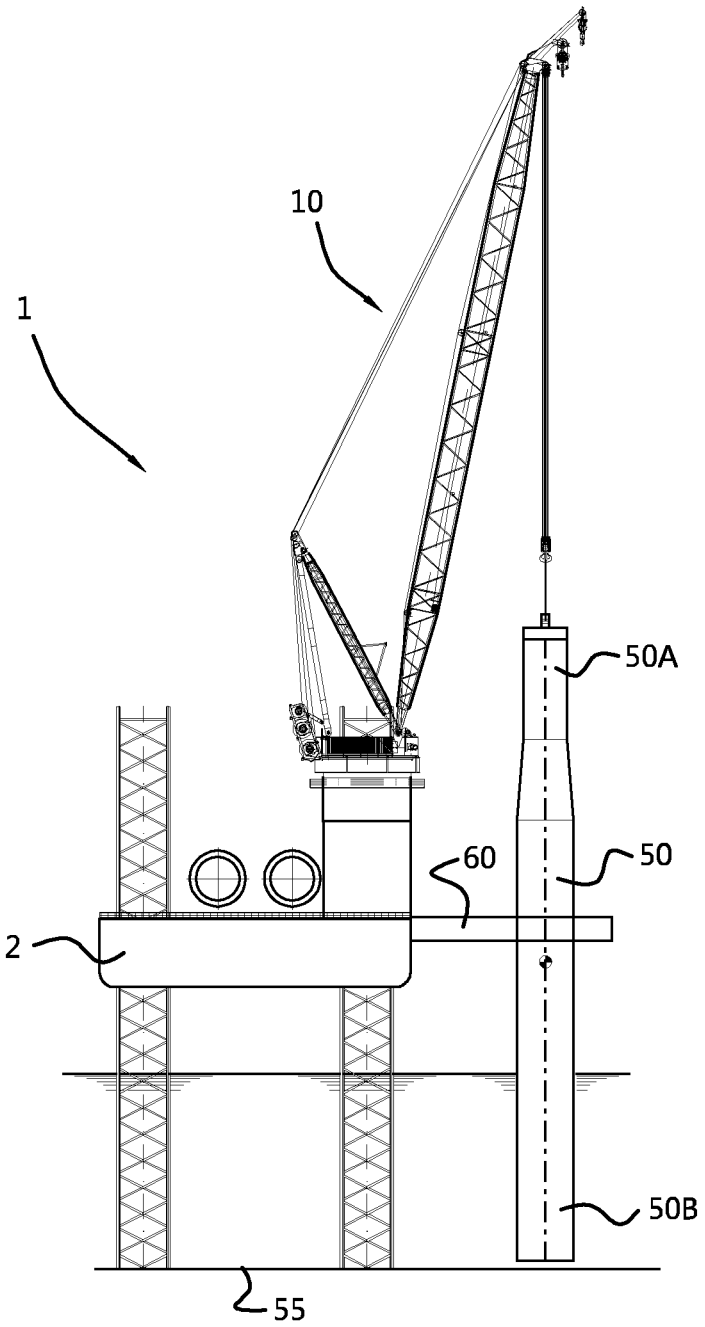
Figure 17B:
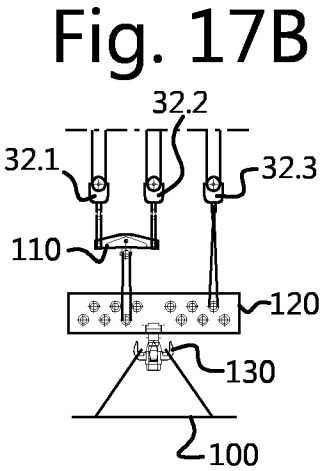
Figure 17A:
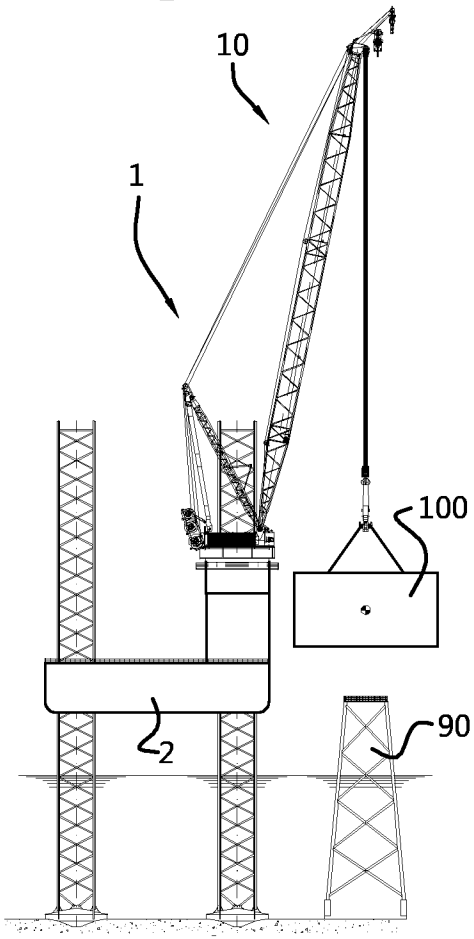
Figure 16:
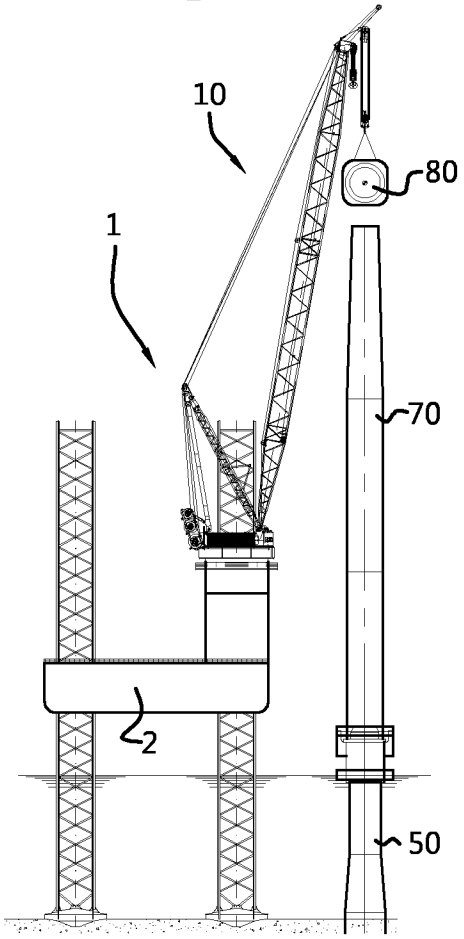
Figure 15:
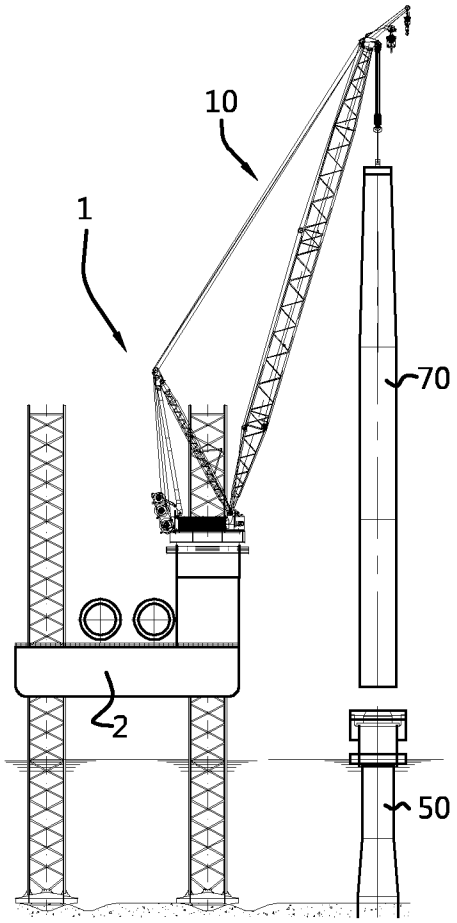

FIGS. 6A+6B depict respectively a side view and a front view of a first configuration of the three main hoisting systems of the crane of the vessel of FIG. 1;

FIGS. 7A+7B depict respectively a side view and a front view of a second configuration of the three main hoisting systems of the crane of the vessel of FIG. 1;

FIGS. 8A+8B depict respectively a side view and a front view of a third configuration of the three main hoisting systems of the crane of the vessel of FIG. 1;

FIG. 9 depicts the rear side of the vessel of FIG. 1 in plan view;

FIG. 10 depicts a rear view of the vessel of FIG. 1;

FIG. 11 depicts a step in the method for up-ending a monopile;

FIG. 12 depicts a further step in the method for up-ending a monopile;

FIG. 13 depicts yet a further step in the method for up-ending a monopile;

FIG. 14 depicts a preparatory step for driving a monopile into a sea bottom with the vessel of FIG. 1;

FIG. 15 depicts the vessel of FIG. 1 during installation of a tower on a monopile foundation;

FIG. 16 depicts the vessel of FIG. 1 during installation of a nacelle on the tower of FIG. 15 after installation of said tower;

FIG. 17A depicts the vessel of FIG. 1 during installation of a platform on another type of foundation; and FIG. 17B depicts an example of connecting the three main hoisting systems.

Figure 2:
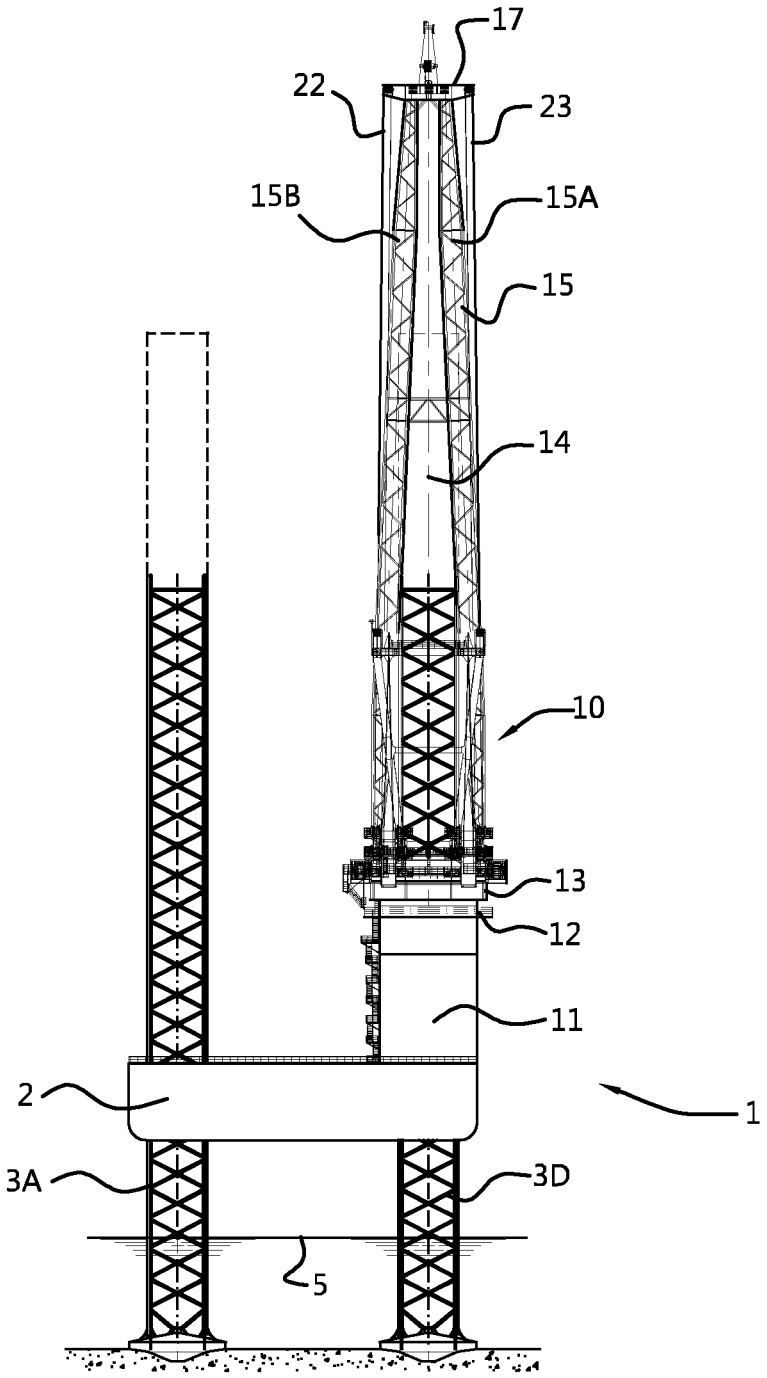
FIG. 2 depicts a rear view of the vessel of FIG. 1.
Figure 3:
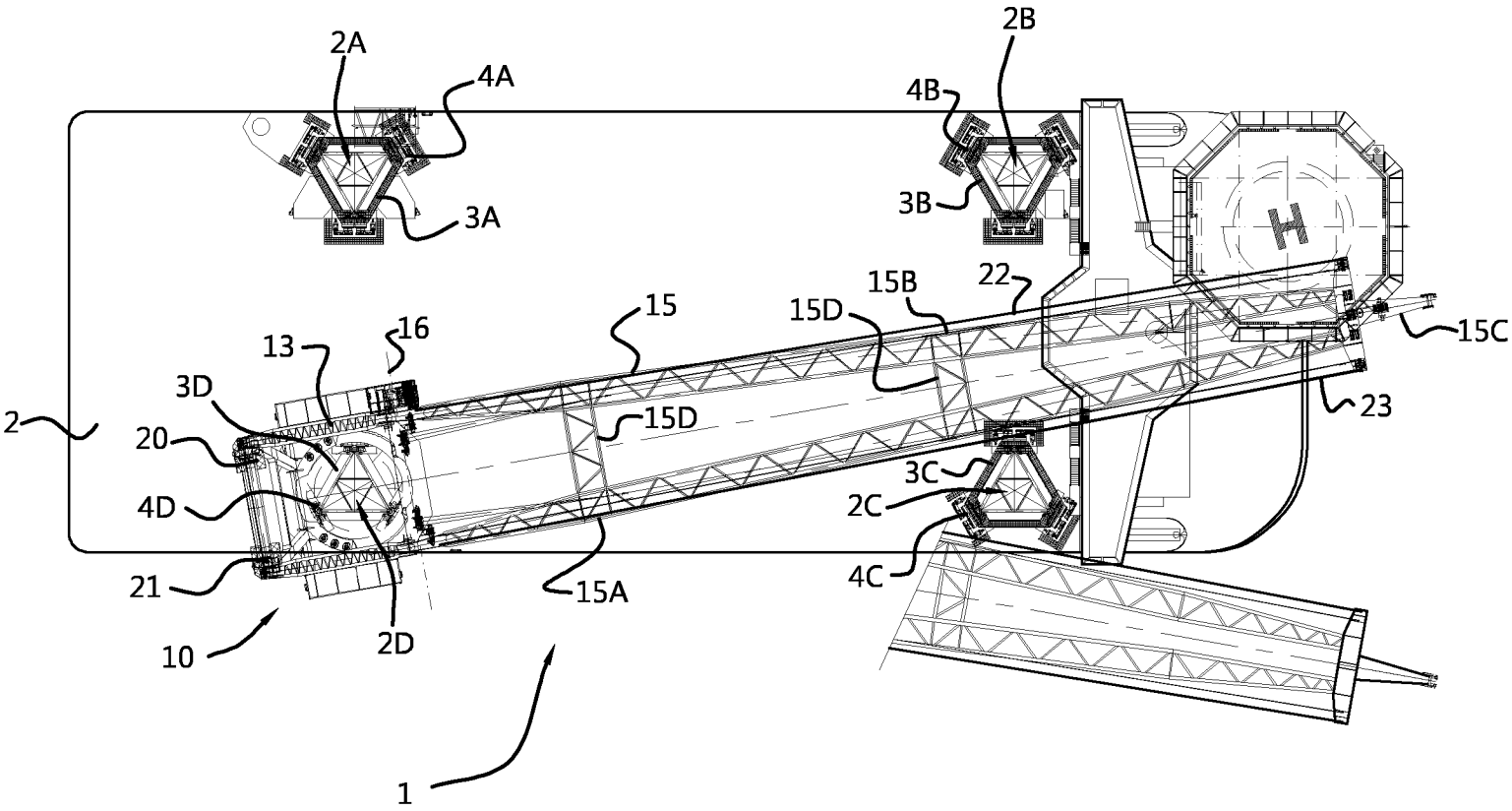
FIG. 3 depicts a top view of the vessel of FIG. 1.

FIGS. 1 to 3 depict a vessel 1 according to an embodiment of the invention. FIG. 1 is a side view of the vessel 1, FIG. 2 is a rear view of the vessel 1, and FIG. 3 is a top view of the vessel 1.

The vessel 1 comprises a hull 2 with four openings 2A, 2B, 2C, 2D in the hull 2, wherein the openings extend vertically through the hull 2 to receive a respective leg 3A, 3B, 3C, 3D.

Each leg 3A, 3B, 3C, 3D is provided with a leg driving device 4A, 4B, 4C, 4D allowing to move the corresponding leg 3A, 3B, 3C, 3D up and down relative to the hull 2 in a vertical direction to allow the hull 2 to be lifted out of a water body 5 as shown in FIGS. 1 and 2. Hence, the vessel 1 is a jack-up vessel. The height of the legs 3A, 3B, 3C, 3D relative to the hull 2 when the legs are retracted for sailing with the vessel is indicated by dashed lines above the respective legs.

Provided on the vessel 1 is a crane 10. The crane 10 comprises a base structure 11 mounted to the hull 2, a slew bearing 12 and a crane housing 13 moveably mounted to the base structure 11 via the slew bearing 12 to allow the crane housing 13 to slew relative to the base structure 11 about a substantially vertical slewing axis 14.

The crane 10 further comprises a boom 15. The boom 15 is moveably mounted to the crane housing 13 to allow the boom 15 to pivot relative to the crane housing 13 about a substantially horizontal first pivot axis 16. In FIG. 1, the boom is depicted at two distinct angular orientations, a lower orientation in which the boom 15 is supported by the vessel at a distance from the horizontal first pivot axis 16, and an upright orientation in which the boom 15 is almost vertical.

The boom 15 comprises an A-frame with two boom legs 15A, 15B that are connected at one end to the crane housing, thereby defining the first pivot axis 16, and are connected at the opposite end to each other via a hammerhead structure 17. In between the two ends, the boom legs are connected by intermediate connection members 15D to increase the stiffness of the A-frame.

The boom legs in this embodiment are truss structures as are the intermediate members 15D. The hammerhead structure 17 may have a box structure. The box structure of the hammerhead structure may make it easier to mount components thereto while at the same time a torsion stiff structure is formed. The truss structures of the boom legs have the advantage that they provided a good stiffness to weight ratio.

The crane further comprises a luffing system to set an angular orientation of the boom 15 relative to the crane housing 13. The luffing system comprises two luffing winches 20, 21 on the crane housing 13, and two respective luffing cables 22, 23 extending between the two luffing winches 20,21 on the crane housing 13 and the boom 15. One combination of luffing winch 20 and luffing cable 22 is arranged on one side of the crane 10, while the other combination of luffing winch 21 and luffing cable 23 is arranged on the opposite side of the crane 10 thereby passing the leg 3C on both sides.

In this embodiment, the distance between the boom legs 15A, 15B of the A-frame at the legs 3B and 3C is not large enough to position the A-frame over the legs for storage or transport reasons. Hence, therefore the boom is supported from the hull 2 in between the two legs 3B, 3C as shown in FIGS. 1 and 3. However, it is also possible to position the boom on the opposite side of leg 3C as shown partially in FIG. 3, which has the advantage that more deck space is available for storage of other components.

Figure 4:
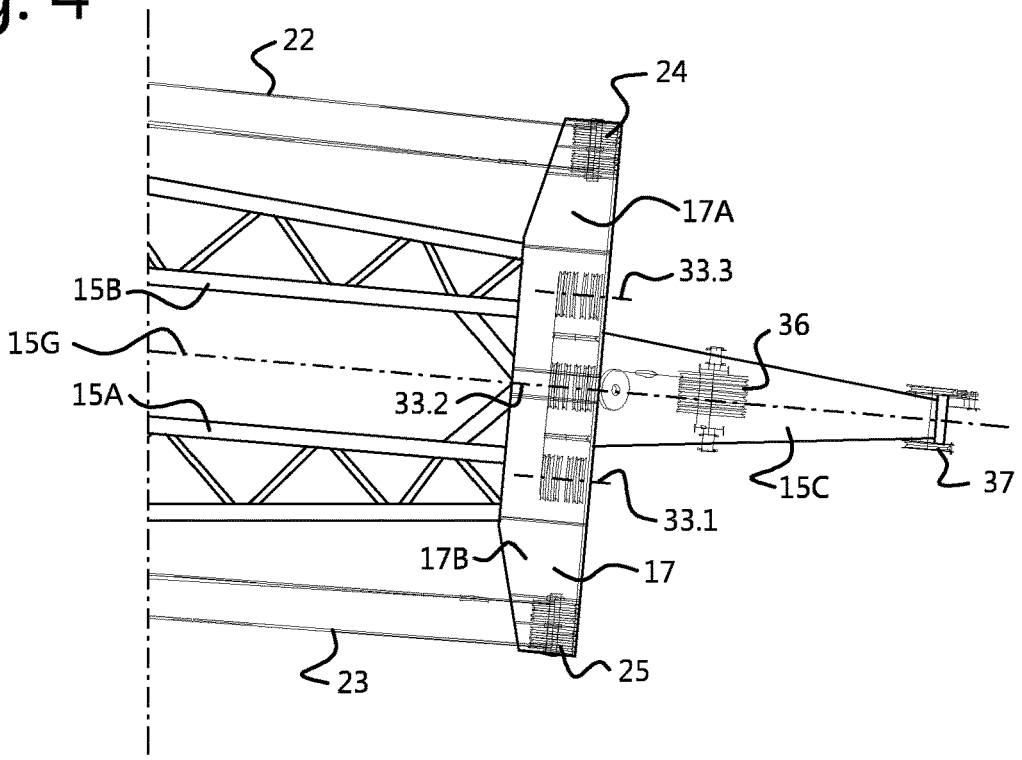
FIG. 4 depicts in more detail an end of the boom of the crane on the vessel of FIG. 1.
Figure 5:
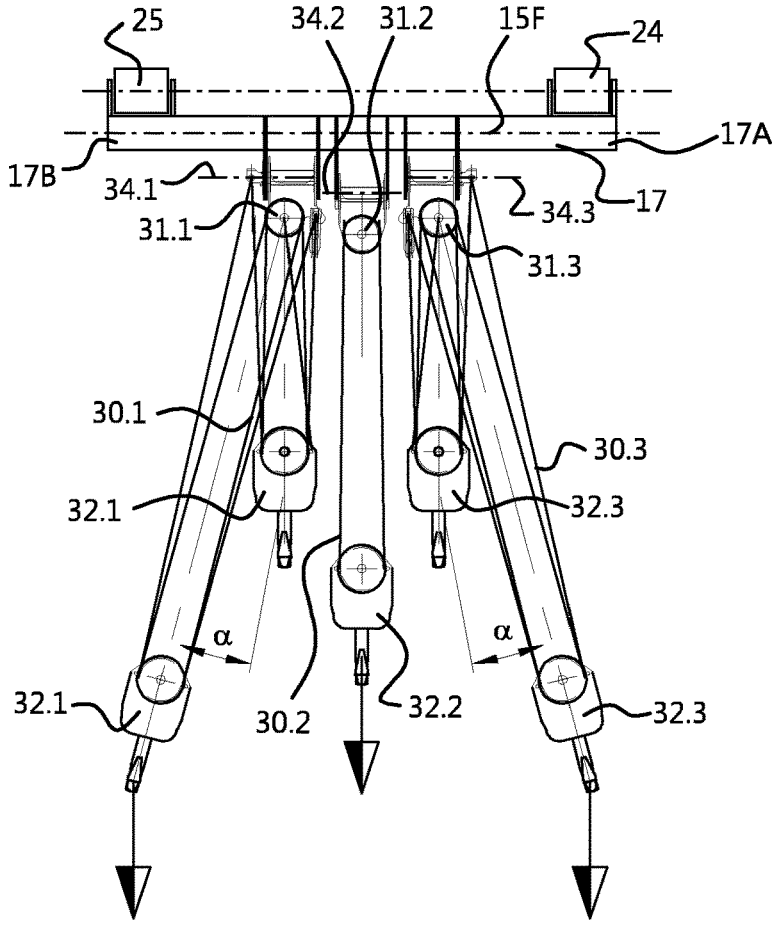
FIG. 5 depicts in more detail the hammerhead structure on the boom of the crane of the vessel of FIG. 1.

The hammerhead structure 17 at the end of the A-frame and nearby components of the boom 15 are depicted in more detail in FIGS. 4 and 5.

In FIG. 4, the boom legs 15A, 15B of the A-frame are depicted and it can be clearly seen that the boom legs are connected to each other via the hammerhead structure 17. The hammerhead structure 17 comprises outriggers 17A, 17B extending beyond the boom legs 15A, 15B of the A-frame seen in plan view. Each outrigger 17A, 17B comprises a respective sheave block 24, 25 to which the respective luffing cables 22 and 23 are connected, thereby allowing to set the angular orientation of the boom relative to the crane housing by paying out or hauling in the luffing cables 22, 23 with the luffing winches 20,21. The sheave blocks 24, 25 are also schematically depicted in FIG. 5.

The crane 10 further comprises three main hoisting systems. Components of the three main hoisting systems will be indicated using a similar reference numeral followed by a . X, where X will be 1, 2 or 3 to indicate one of the three main hoisting systems.

Each main hoisting system comprises a hoisting cable 30.1, 30.2, 30.3, a sheave block 31.1, 31.2, 31.3, and a hoisting block 32.1, 32.2, 32.3. Each sheave block 31.1, 31.2, 31.3 comprises in this embodiment a plurality of sheaves that are rotatable about a respective sheave rotation axis 33.1, 33.2, 33.3. The sheave blocks 31.1, 31.2, 31.3 are arranged on the hammerhead structure, in this embodiment within the contour of the A-frame, i.e. not arranged on the outriggers 17A, 17B, in a side-by-side configuration, in this case in a row seen in plan view.

The rotation axes 33.1, 33.2, 33.3 of the sheaves of the sheave blocks provide one degree of freedom for the hoisting cable, which degree of freedom is normally used in combination with gravity to keep the hoisting block below the corresponding sheave block independent of the angular orientation of the boom relative to the crane housing. In this embodiment, this degree of freedom is used to allow a sideways movement of the hoisting blocks as is for instance shown in FIG. 5 for the outer hoisting blocks. In FIG. 5, the outer hoisting blocks are moved sideways by an angle $\alpha$, which can be easily be 40 degrees.

In order to keep the hoisting blocks 32.1, 32.2, 32.3 below the sheave blocks 31.1, 31.2, 31.3 independent of the angular orientation of the boom 15, each sheave block 31.1, 31.2, 31.3 is pivotable about a substantially horizontal second pivot axis 34.1, 34.2, 34.3 perpendicular to the sheave rotation axis 33.1, 33.2, 33.3 of the corresponding sheaves of the sheave block 31.1, 31.2, 31.3.

The three main hoisting systems each further comprise a hoisting winch 35.1, 35.2, 35.3 (see FIG. 1) to lift and lower the hoisting block 32.1, 32.2, 32.3 by hauling in or paying out the hoisting cable 30.1, 30.2, 30.3.

The boom 15 of the crane 10 further comprises a jib 15C extending from the A-frame, i.e. extending from the hammerhead structure 17 carrying, in this embodiment, two auxiliary hoisting systems, which are similar to a main hoisting system except that the loading capacity is usually smaller and that the additional degree of freedom for the sheave blocks is not provided. In FIG. 4, a sheave block 36 associated with a first auxiliary hoisting system and a sheave block 37 associated with a second auxiliary hoisting system are depicted.

Figure 6B:
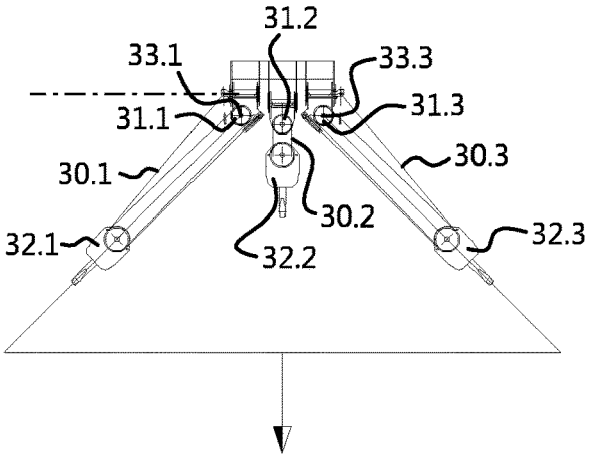

An advantage of the crane 10 according to the invention is that the three main hoisting systems can be used in various ways depending on the hoisting demand. A first example is depicted in FIGS. 6A and 6B, in which FIG. 6A is a side view of FIG. 6B. In this example, only the outer hoisting blocks 32.1, 32.3 are used. The outer hoisting blocks are pivoted sideways about respective axes 33.1, 33.3 allowing to be connected to a longitudinal structure with a relatively large distance between the hoisting block. This hoisting configuration is especially suitable in case the hoisting blocks are lifted and lowered simultaneously and thus carry a load in the same order of magnitude. The two outer hoisting systems allow to control movement of the hoisted objects in two degrees of freedom.

Figure 7B:
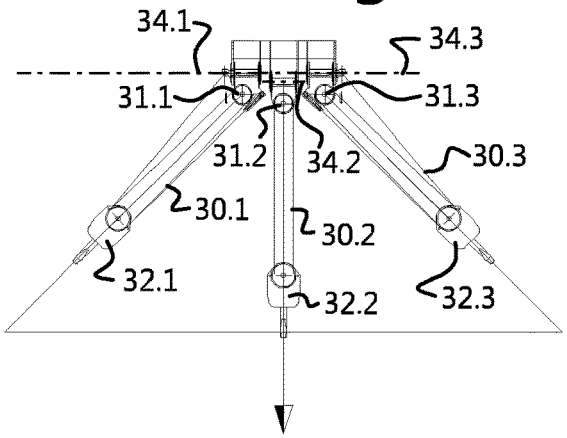

A second example is depicted in FIGS. 7A and 7B, in which FIG. 7A is a side view of FIG. 7B. In this example, all hoisting blocks are used. The outer hoisting blocks 32.1, 32.3 are spread similar to the example of FIGS. 6A and 6B, but the hoisting blocks are also pivoted about respective second pivot axes 34.1 and 34.2. The middle hoisting block 32.3 is kept straight seen in the view of FIG. 7B, but is also pivoted about second pivot axis 34.2, albeit in an opposite direction as the outer hoisting blocks 32.1 and 32.3. As a result thereof, the three main hoisting systems can be connected to three distinct locations of an object, which three locations form a triangle seen in plan view. This hoisting configuration is especially suitable in case the hoisting blocks are lifted and lowered simultaneously and thus carry a load in the same order of magnitude. The configuration further allows to control movement of the hoisted object in three degrees of freedom.

Figure 8B:
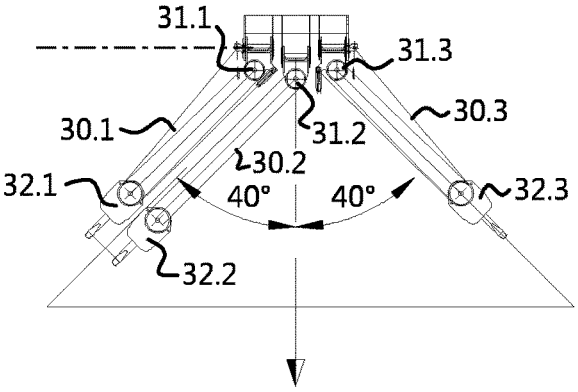

A third example is depicted in FIGS. 8A and 8B, in which FIG. 8A is a side view of FIG. 8B. In this example, all hoisting blocks are used, but one of the outer hoisting blocks, in this case outer hoisting block 32.1 is combined with the middle hoisting block 32.2 to hoist one end of an object and the other outer hoisting block, in this case outer hoisting block 32.3, is used to hoist another end of an object. This configuration is especially suitable for situations in which during hoisting the load is or becomes asymmetrical, e.g. during up-ending of longitudinal structures.

It is noted with respect to the example of FIGS. 8A and 8B that the sheave block 31.2 associated with the middle hoisting block 32.2 is arranged somewhat lower than the other sheave blocks 31.1 and 31.3. In other words, a centre plane 15F of the A-frame can be defined as the plane spanned by the first pivot axis 16 and the longitudinal axis 15G of the A-frame, wherein the middle sheave block 31.2 is mounted at a larger distance from the centre plane 15F than the other two outer sheave blocks 31.1 and 31.3. The advantage of this arrangement is that for large angles $\alpha$, in this embodiment an angle of 40 degrees, the hoisting cables 30.1 and 30.2 are not too close to each other (do not touch or interfere with each other) and in this case are parallel to each other.

With reference to FIGS. 9-13, a method according to the invention will be described in which a monopile is up-ended by the crane 10 on the vessel 1 of FIG. 1. FIGS. 9 and 10 depict the rear side of the vessel 1 with the hull 2 and legs 3A and 3D and crane 10 arranged around leg 3D.

On a deck 2E of the hull 2 of the vessel, a stack of monopiles 50 are provided in a substantially horizontal orientation. As shown in FIG. 9, the monopiles 50 may even extend beyond the rear side of the hull 2. Alternatively, the monopiles may be provided using a separate vessel, e.g. a barge.

In FIG. 9, the boom 15 of the crane 10 is positioned for hoisting the nearest monopile 50, i.e. the monopile 50 nearest to leg 3D, and in FIG. 10, the boom 15 of the crane 10 is positioned for hoisting the monopile 50 nearest to leg 3A. Both monopiles 50 have been positioned relative to the crane 10, such that in plan view (see FIG. 9) a straight line between a centre of gravity 50C of the longitudinal structure and the slewing axis 14 of the crane 10 is perpendicular to a longitudinal axis 50D of the longitudinal structure 50.

FIG. 11 depicts a monopile 50 that is suspended by the three main hoisting systems of the crane 10 (which is further omitted for clarity reasons) using the configuration of FIGS. 8A and 8B. Hence, the middle hoisting block 32.2 of the three main hoisting systems and one of the outer hoisting blocks 32.1 are connected to an upper end 50A of the monopile 50 via connection element 51.

The other outer hoisting block 32.3 is connected to a lower end 50B of the monopile 50 using a gripping element 52 that is provided around the lower end 50B of the monopile 50.

By synchronized hauling in of the hoisting cables 30.1, 30.2, possibly in combination with the paying out of hoisting cable 30.3, the monopile 50 is up-ended. FIG. 12 depicts the monopile 50 in an oblique orientation halfway the up-ending process, and FIG. 13 depicts the monopile 50 after up-ending. In FIG. 13 it can be clearly seen that when the hoisting blocks 32.1, 32.2 are connected to a centre of the monopile and the hoisting block 32.3 is connected to the gripping element on the side of the monopile, the hoisting cables 30.1, 30.2, 30.3 are nearly parallel to each other.

After up-ending, the gripping element 52 and thereby the outer hoisting block 32.3 are disengaged for driving the monopile into a sea bottom 55. While lowering the monopile 50 towards the sea bottom 55, the monopile 50 may be guided by a guide 60 extending from the hull 2 as shown in FIG. 14. The weight of the monopile itself will cause the monopile to be partially driven into the sea bottom. The monopile can then be disconnected from the hoisting systems and a separate device for driving the monopile further into the sea bottom may be provided.

FIG. 15 depicts the use of the crane 10 to install a tower 70 on top of the previously installed monopile 50. The tower may have a lower weight than the monopile, so that in case of up-ending the tower, if applicable, the crane may use the hoist configuration of FIGS. 6A and 6B. In case the tower is too heavy, the hoist configuration of FIGS. 8A and 8B can be used.

FIG. 16 depicts the use of the crane 10 to install a nacelle 80 on top of the previously installed tower 70. In this embodiment, the nacelle is such a light weight component that the nacelle can be hoisted by the first auxiliary hoisting system.

FIG. 17A depicts the use of the crane 10 to install a platform 100 on top of a previously installed other foundation 90 in the form of a truss construction. In this embodiment, platform 100 has a weight requiring all three hoisting systems to use the combined hoisting capacity.

However, when connecting all three hoisting blocks 32.1, 32.2, 32.3 directly to the platform or indirectly via single connection element whereto the three hoisting blocks are directly connected to, it is not possible to use the full potentially available hoisting capacity.

Hence, for these cases, two of the hoisting blocks, in this embodiment hoisting blocks 32.1 and 32.3 are connected to a first intermediate member 110, see FIG. 17B. The first intermediate member 110 and the other remaining hoisting block 32.3 are connected to a second intermediate member 120. Connected to the second intermediate member 120 is a load connector 130 to be connected to the platform 100. The connections between the hoisting blocks and intermediate members and the connection between the first and second intermediate members are such that the load of the platform 100 is substantially evenly distributed over the three hoisting systems, e.g. by providing sheave and cable connections between the various components.

It is noted here that although the examples and embodiments described disclose the use of a specific number of winches, cables and sheaves, it is apparent to the skilled person that additional components may be provided. Hence, it is very common to use two winches for one hoisting or luffing cable or to provide additional combinations of winch and cable. In other words, any specific number provided in the description should be construed as meaning at least that specific number. The same holds for the number of main hoisting systems. Although three main hoisting systems have been described, a fourth and even a fifth main hoisting system may be provided and falls within the scope of the invention.

What is claimed is:

1. A method for up-ending a longitudinal structure, said longitudinal structure being one of a foundation of an offshore wind turbine or a wind turbine tower to be installed on top of a previously installed foundation, wherein use is made of a crane comprising:

a base structure;

a slew bearing;

a crane housing moveably mounted to the base structure via the slew bearing to allow the crane housing to rotate relative to the base structure about a substantially vertical slewing axis;

a boom moveably mounted to the crane housing to allow the boom to pivot relative to the crane housing about a substantially horizontal first pivot axis at one end of the boom, said boom having an opposite end remote from said one end; and three main hoisting systems, wherein each main hoisting system comprises:

a hoisting cable;

a sheave block with one or more sheaves that are rotatable about a sheave rotation axis, the sheave block being arranged on the opposite end of the boom;

a hoisting block suspended from the sheave block by the hoisting cable; and a hoisting winch to lift and lower the hoisting block by hauling in or paying out the hoisting cable, wherein the sheave block of each main hoisting system is pivotable about a substantially horizontal second pivot axis that is perpendicular to the sheave rotation axis of the one or more sheaves of the sheave block, wherein the sheave blocks of the three main hoisting systems are arranged side-by-side, and wherein the method comprises the following steps:

a) providing a longitudinal structure with an upper end and a lower end in a substantially horizontal orientation;

b) connecting the middle hoisting block of the three main hoisting systems and one of the outer hoisting blocks of the three main hoisting systems to the upper end of the longitudinal structure;

c) connecting the other outer hoisting block of the three main hoisting systems to the lower end of the longitudinal structure; and d) operating the respective winches of the three main hoisting systems until the longitudinal structure is in a substantially vertical orientation with the upper end above the lower end.

2. The method according to claim 1, wherein step c) comprises the following steps:

c1) providing a gripping element;

c2) providing the gripping element around the lower end or lower end portion of the longitudinal structure; and c3) connecting the other outer hoisting block of the three main hoisting systems to the gripping element.

3. The method according to claim 1, wherein the longitudinal structure is a monopile as a foundation of an offshore wind turbine.

4. The method according to claim 1, wherein the boom comprises an A-frame with two boom legs that are connected at said one end to the crane housing and at said opposite end to each other via a connection element.

5. The method according to claim 1, wherein the crane comprises a luffing system to set an angular orientation of the boom relative to the crane housing, and wherein the boom comprises an A-frame with two boom legs that are connected at said one end to the crane housing and at said opposite end to each other via a hammerhead structure, wherein the luffing system comprises:

two luffing winches on the crane housing; and two luffing cables extending between the respective two luffing winches on the crane housing and the boom, and wherein the luffing cables are connected to respective outriggers of the hammerhead structure that extend beyond the boom legs of the A-frame seen in plan view.

6. The method according to claim 1, wherein use is made of a jack-up vessel, and wherein the base structure of the crane is mounted on the jack-up vessel, said jack-up vessel comprising:

a hull with at least three openings in the hull, said openings extending vertically through the hull to receive a respective leg;

a leg per opening in the hull; and a leg driving device per leg allowing to move the corresponding leg relative to the hull in a vertical direction to allow the hull to be lifted out of a water body.

* * * * *